US005884619A

United States Patent [19]

Terry

[11] Patent Number: 5,884,619

[45] Date of Patent: Mar. 23, 1999

[54] COOK TOP INTAKE DIRECTOR

[76] Inventor: William H. Terry, 10 Goundry Dr., Waterford, Conn. 06385

[21] Appl. No.: 938,731

[22] Filed: Sep. 26, 1997

[51] Int. Cl.[6] ..... F24C 15/20

[52] U.S. Cl. ..... 126/299 D

[58] Field of Search ..... 126/299 D, 300, 126/299 R

[56] References Cited

U.S. PATENT DOCUMENTS

| | | | |
|---|---|---|---|
| 2,076,479 | 4/1937 | O'Connell | 126/299 |
| 3,409,005 | 11/1968 | Field | 126/299 |
| 3,712,819 | 1/1973 | Field | 126/299 |
| 3,954,427 | 5/1976 | Jenn | 55/217 |
| 4,291,668 | 9/1981 | Moeller | 126/41 R |
| 4,446,849 | 5/1984 | McFarland | 126/299 R |
| 4,501,260 | 2/1985 | Grace | 126/299 R |
| 4,562,827 | 1/1986 | Cerola | 126/299 R |
| 4,736,729 | 4/1988 | Beach | 126/39 R |
| 4,766,880 | 8/1988 | von Blanquet | 126/299 R |
| 4,821,704 | 4/1989 | Tucker et al. | 126/299 D |
| 4,846,146 | 7/1989 | Tucker et al. | 126/299 D |
| 4,934,337 | 6/1990 | Falk | 126/299 R |
| 5,062,410 | 11/1991 | Sarnosky et al. | 126/299 D |
| 5,190,026 | 3/1993 | Doty | 126/39 R |
| 5,231,972 | 8/1993 | Galassi | 126/299 R |
| 5,279,279 | 1/1994 | White | 126/299 D |
| 5,619,982 | 4/1997 | Kelley et al. | 126/299 D |

*Primary Examiner*—Carroll B. Dority
*Attorney, Agent, or Firm*—Albert W. Hilburger

[57] ABSTRACT

A portable airflow director, preferably of stainless steel, for ventilating a cook top adjacent to a cooking unit comprises an elongated housing including a base for removable engageable reception with an exhaust intake in the cook top, the base defining an opening in communication with the exhaust intake when the housing is placed on the cook top. A louvered side wall, disposed at an angle of approximately 45° relative to a plane of the base, directs the flow of air from the cooking unit into, then through, the housing and through the exhaust intake of the cook top. The airflow director includes a pair of end walls which lie in parallel spaced apart planes and, in one embodiment, a solid side wall is positioned opposite and angularly disposed with respect to the louvered side wall, the end walls and the solid side wall being impervious to the flow of air. In another embodiment, the airflow director includes opposed louvered side walls extending between the end walls. A baffle plate extends between the end walls intermediate the first and second louvered side walls for simultaneously directing the flow of air from opposed first and second cooking units, respectively, through the first and second louvered side walls into, then through, the housing and through the exhaust intake of the cook top.

12 Claims, 3 Drawing Sheets

FIG. 2.
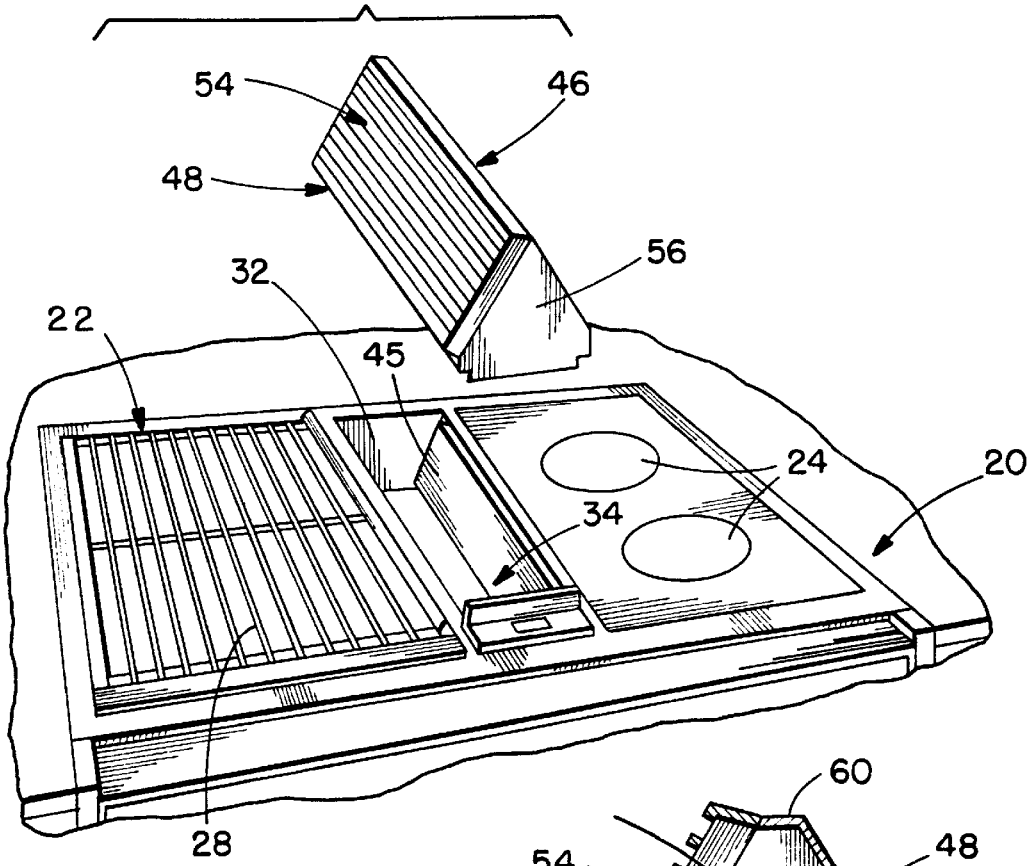
FIG. 5.
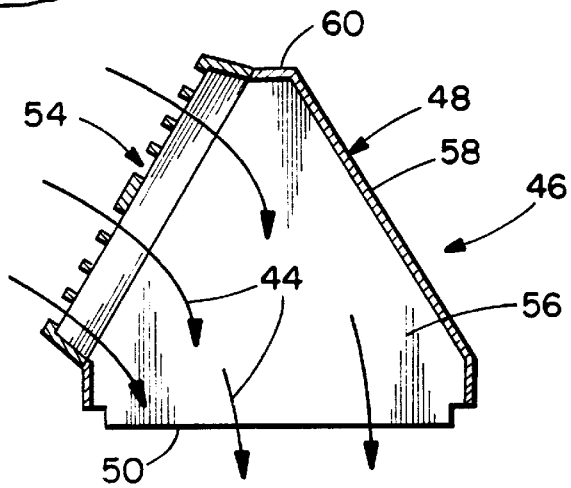
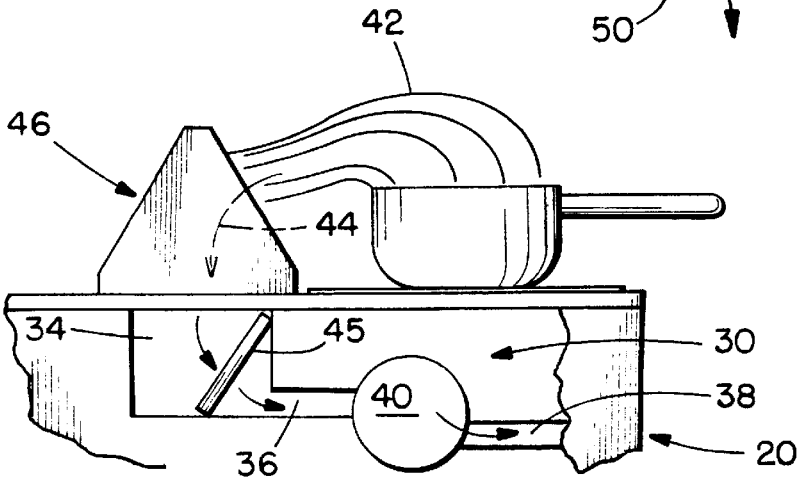
FIG. 3.

COOK TOP INTAKE DIRECTOR

BACKGROUND OF THE INVENTION

1. Field of the Invention

The present invention relates generally to kitchen appliances and, more particularly, to apparatus for venting heat, smoke, gasses, and the like, from a surface cooking appliance. More specifically, the invention is a portable airflow director for ventilating a cook top adjacent to a cooking unit an existing surface cooking appliance and is removably receivable over an outlet in the cook top in communication with a suction exhaust of the down draft type.

2. Description of the Prior Art

A common type of cooking unit designed for domestic use is the cooking range wherein electrical resistor or gas burner heater units are mounted in a counter top within a kitchen area of a home Numerous types of apparatus have been devised for providing ventilation of the vapors generated during cooking on such units. For example, a hood may be positioned over the cooking unit to draw off effluents such as smoke, heat, vapor, grease or other particles generated during cooking The aforementioned range hoods provide effective ventilation since their positioning above the cooking unit compliments the natural convection of the cooking effluents. However, the size and bulkiness of the hood often makes it less aesthetically pleasing within a domestic kitchen.

A more recent approach is to mount the ventilator or suction assembly beside or within the cooking unit so that the ventilator opening receiving the cooking effluents lie flush with the surface of the cooking range unit. Typical of such cooking ranges are U.S. Pat. No. 3,409,005 assigned to Jenn-Air Corporation of Indianapolis, Ind. This "down-draft" cooking range ventilator possesses the advantage of both compactness and aesthetic appeal to the consumer. However, such down-draft ventilators do suffer from a number of disadvantages. For example, although smoke, particles and other fumes are mostly removed from the general area surrounding the cooking range during cooking, there still exits visible as well as invisible flow or vaporized grease or particles that are not sufficiently pulled within the suction inlet of the ventilator. Consequently, if the fumes containing the grease and smoke are excessive, the down-draft ventilator is insufficient to withdraw all of the effluent into the suction inlet for discharge. Smoke and fumes which escape the ventilator are often then deposited along the ceiling and walls of the kitchen or in the area immediately adjacent the stove. Over a period of time such deposits can accumulate causing problem which is not only unsightly and requires extensive clean up, it is also a potential fire and health hazard. Present attempts to remedy the problem have relied upon installation of an electric motor which is sufficiently powerful to remove all the vapors generated during cooking This approach has almost always fallen short of expectations Other, more recent, patented examples of this approach are disclosed in U.S. Pat. No. 5,231,972 to Galassi issued Aug. 3, 1993, U.S. Pat. No. 4,934,337 to Falk issued Jun. 19, 1990, and U.S. Pat. No. 4,446,849 to McFarland issued May 8, 1984.

The following U.S. patents all disclose stationary ventilating flues for use with surface cooking units which, in some instances, have dampers which may be moved between open and closed positions: U.S. Pat. No. 4,766,880 to von Blanquet issued Aug. 30, 1988, U.S. Pat. No. 4,291,668 to Moeller issued Sep. 29, 1981, and U.S. Pat. No. 3,712,819 to Field issued Jan. 23, 1973.

U.S. Pat. No. 5,279,279 to White issued Jan. 18, 1994 is particularly pertinent to the present invention, disclosing an adjustable deflector device for selective positioning above the ventilator of a cooking range of the type where the ventilator is disposed adjacent to and flush with the cooking range heating elements.

It was with knowledge of the foregoing disclosures representative of the state of the art that the present invention was conceived and has now been reduced to practice.

SUMMARY OF THE INVENTION

The present invention relates to a portable airflow director, preferably of stainless steel, for ventilating a cook top adjacent to a cooking unit. It comprises an elongated housing including a base for removable engageable reception with an exhaust intake in the cook top, the base defining an opening in communication with the exhaust intake when the housing is placed on the cook top. A louvered side wall, which may be the original equipment exhaust intake grill flush with the cooking surface, is disposed at an angle of approximately 45° relative to a plane of the base and directs the flow of air from the cooking unit into, then through, the housing and through the exhaust intake of the cook top. The airflow director includes a pair of end walls which lie in parallel spaced apart planes and, in one embodiment, a solid side wall is positioned opposite and angularly disposed with respect to the louvered side wall, the end walls and the solid side wall being impervious to the flow of air. In another embodiment, the airflow director includes opposed louvered side walls extending between the end walls. A baffle plate extends between the end walls intermediate the first and second louvered side walls for simultaneously directing the flow of air from opposed first and second cooking units, respectively, through the first and second louvered side walls into, then through, the housing and through the exhaust intake of the cook top.

In another manner of speaking, the portable airflow director of the invention is designed to raise the effective height and direction of the exhaust unit surface on the top of ranges. The device is, preferably, a stainless steel chamber to which the factory exhaust surface is attached and fits into the opening of the range top. The chamber is designed to allow the unit, with no other modifications, to effectively exhaust smoke and odors and the like both from the burners side and from the grill side of the unit. Features of the invention include the following: it fits many Jenn-Air style cook tops that have a removable grill; fabricated from stainless steel; utilizes existing cook-top vent grill; raises the vent grill to approximately 45 degree angle; and washable in the dishwasher. The competitive advantages, as noted by the client include: simple to use, no extreme installation method, and more effectively removes smoke from the cook top.

The invention comprises a stainless steel metal housing which raises the original vent intake grill and brings it closer to the actual source of the smoke and cooking odors. The entire assembly (housing and original intake grill) fits on top of the Jenn-Air style vent opening without any modification.

Since air velocity near an intake grill falls very rapidly just a few inches from the grill, anything that can be done to bring the vent opening closer to the source of smoke and odors will improve the intake system's ability to capture these fumes.

Features of the portable airflow director of the invention include the following:

It fits may Jenn-Air style cook tops that have a removable grill;

It may be fabricated of sheet metal for durability and, preferably, stainless steel to assure that it will be aesthetically pleasing;

It utilizes existing cook top vent grills;

It effectively raises the vent grill of existing units to approximately a 45° angle;

The entire assembled one-piece unit can be washed in an automatic dishwasher.

A primary object of the invention, then, is to provide improved apparatus for venting heat, smoke, gasses, and the like, from a surface cooking appliance.

Another object of the invention is to provide a portable airflow director for ventilating a cook top adjacent to a cooking unit an existing surface cooking appliance.

A further object of the invention is to provide such a portable airflow director which is removably receivable over an outlet in the cook top in communication with a suction exhaust of the down draft type.

Still a further object of the invention is to provide such a portable airflow director for use with a down-draft type cooking range which improves the efficiency of the existing ventilating system in removing smoke, heat and other airborne particles and grease.

Still a further object of the invention is to provide such a portable airflow director which improves the efficiency of a conventional down-draft ventilator for a cooking range by deflecting and increasing flow across the range surface into the ventilator.

Still a further object of the present invention is to provide such a portable airflow director which can be easily cleaned and serviced to thereby reduce maintenance costs.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

FIG. 2 is an exploded perspective view, similar to FIG. 1;

FIG. 3 is a diagrammatic side elevation view of parts illustrated in FIGS. 1 and 2, partially cut away for clarity;

FIG. 5 is a cross section view taken generally along line 5—5 in FIG. 4;

DETAILED DESCRIPTION OF THE PREFERRED EMBODIMENTS

Figure 1:
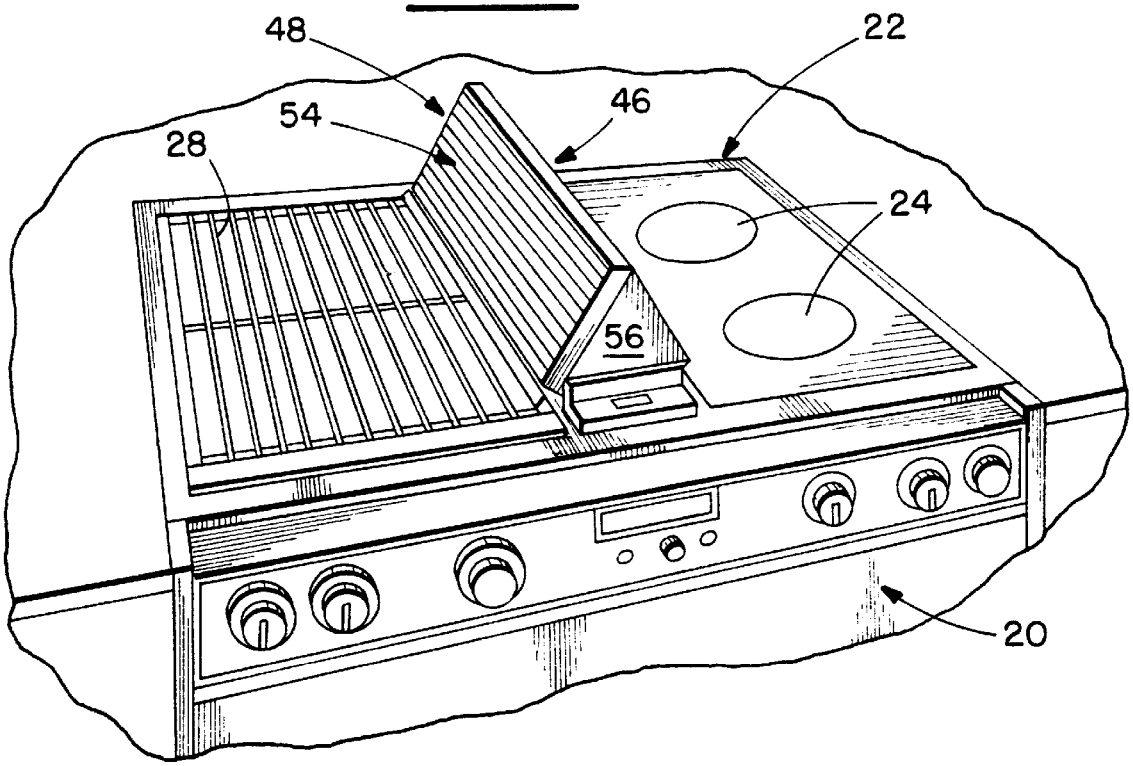
FIG. 1 is a perspective view of a conventional cooking range provided with an exhaust system in its cook top for producing a flow of air from a cooking unit to an external region and utilizing the portable airflow director of the invention.

Turn now to the drawings and, initially, to FIGS. 1 and 2 which generally illustrate a conventional cooking range 20 which in a known manner includes a cook top 22. The cook top may, for example, have gas or electric burners 24 on one side and an open grill unit 28 on the other side, or or burners on both sides or grill units on both sides. The open grill unit 28 may receive its heat variously from charcoal, coal, wood, gas, or electric resistance heaters, or from some other suitable heating source.

The cooking range 20 is also provided, in a customary fashion, with an exhaust system 30 having an exhaust intake 32 in the cook top 22 for producing a flow of air from the cooking unit, whether burners 24 or open grill unit 28, to an external region, that is, to the ambient air. The exhaust system 30 includes a plenum 34 just beneath the level of the surface of the cook top 22 feeding exhaust conduits 36, 38. A suitable fan 40 draws heat, smoke, vapors, and the like as indicated by a reference numeral 42 in the direction of arrows 44 through the plenum 34, across a filter 45, typically an aluminum mesh grease filter, and through the exhaust conduits 36, 38, thence to the external region, that is, to the ambient or surrounding air.

The invention comprises a portable airflow director 46 for directing the flow of air from one of the cooking units 24, 28 to the external region. The airflow director 46 is defined by an elongated housing 48 which includes a base 50 sized and shaped in conformity with the exhaust intake 32. In conventional cooking ranges, the cook top 22 is customarily provided with a removable grate 50 (not shown) which overlies the exhaust intake 32 and is congruent with the exhaust intake 32. For purposes of the present invention, the removable grate is removed from the cooking range 20 and, in its place, the base 50 of the airflow director 46 is removably engageably received on the exhaust intake. The base 50 defines an opening which is in communication with the exhaust intake 32 when the housing 48 is placed on the cook top 22.

While other materials may well be considered, stainless steel is a preferred material to use for fabrication of the housing 48 in view of the fact that the airflow director 46 is located in the midst of the area of food preparation. It is a material which is effectively inert, that is, will not have any deleterious effect on the food being prepared, is strong, is unaffected by the temperatures which it would likely encounter on the cook top 22, is attractive, and would be dishwasher safe.

Figure 4:
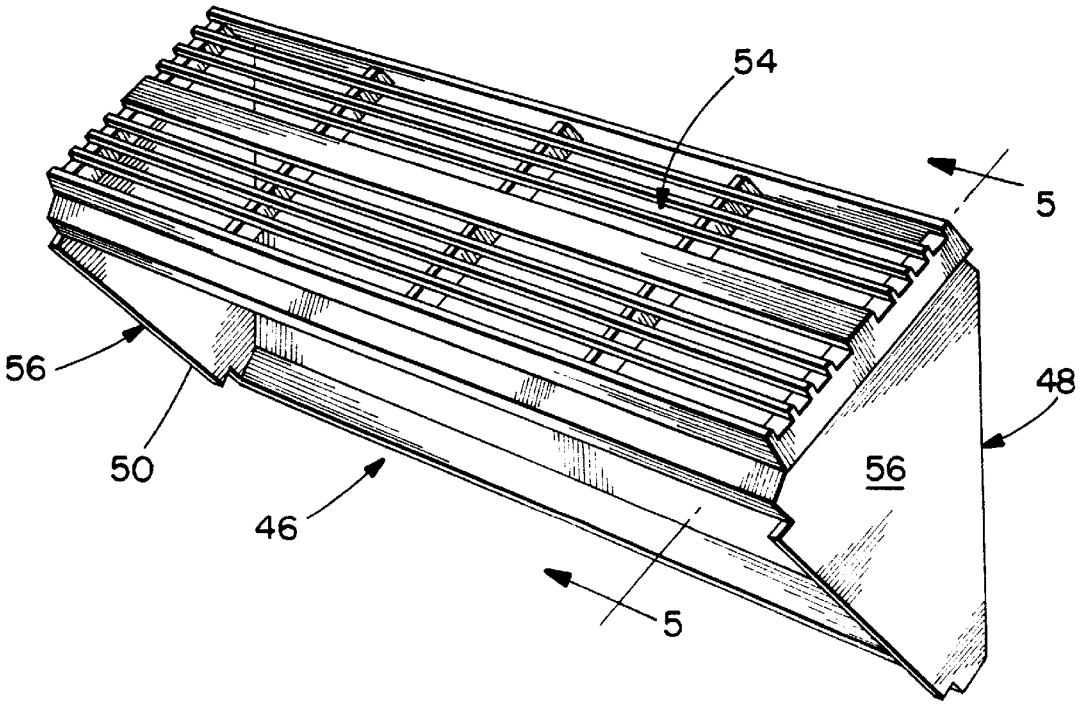
FIG. 4 is a perspective view of the portable airflow director of the invention.

Viewing FIGS. 4 and 5, the airflow director 46 also includes a louvered side wall 54 for directing the flow of air (indicated by the arrows 44) from the cooking unit 24, 28 into, then through, the housing 48 and through the exhaust intake 32 of the cook top. Indeed, the side wall 54 may be the removable grate or grill which was above explained to overlie the exhaust intake of conventional cooking ranges. A pair of end walls 56 lie in parallel spaced apart planes and a solid side wall (FIG. 5) is positioned opposite the louvered side wall 54. The end walls 56 and the solid side wall, respectively, are impervious to the flow of air. As particularly well presented in FIG. 5, the louvered side wall 54 preferably lies in a plane disposed at an angle of approximately 45° relative to a plane of the base 50. In this manner, the airflow director 46 is particularly well situated for drawing in the heat, smoke, and vapors against which conventional exhaust systems were ineffective.

Figure 6:
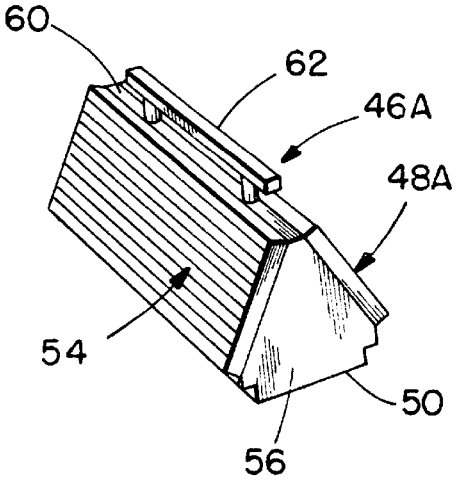
FIG. 6 is a perspective view of another embodiment of the invention.

Again, as seen in FIG. 5, the solid side wall 58 and the louvered side wall 54 lie in intersecting planes angularly disposed in relation to the base 50. The housing 48 includes an integral upper beam member 60 which lies substantially at the intersection of, and joins, the solid side wall 58 and the louvered side wall 54. Viewing FIG. 6, a modified portable airflow director 46A is generally of the construction already described but, in this instance, includes a handle 62 of any suitable type and material mounted on the upper beam member 60. The handle 62 enables a user to selectively move the housing 48A onto and away from the cook top 22.

Figure 7:
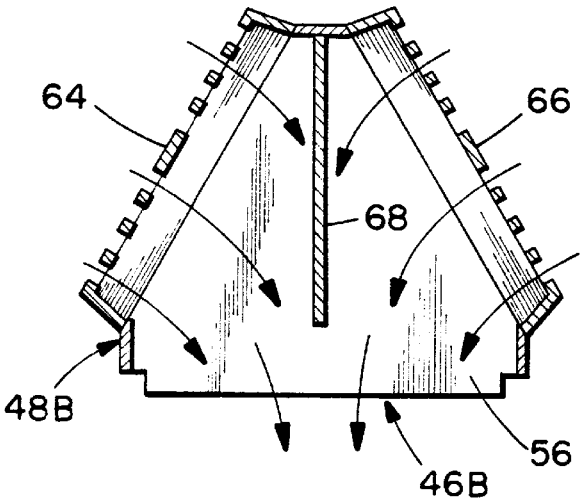
FIG. 7 is a cross section view, similar to FIG. 5, illustrating another embodiment of the invention.

Now tuning to FIG. 7, another modified portable airflow director 46B is illustrated for ventilating a cook top 22 adjacent to and intermediate at least first and second cooking units, for example, between the open grill unit 28 on one side and the burners 24 on the other side. In this instance, the portable airflow director 46B, as modified, comprises a pair of opposed louvered side walls 64, 66 extending between the end walls. Additionally, a baffle plate 68 extends between the end walls 56 intermediate the louvered side walls 64, 66 and depends from a modified upper beam member. The baffle plate 68 serves to direct the flow of air, that is, heat, smoke, vapors, and the like, from a first cooking unit, for example, from the open grill unit 28 through the louvered side wall 64 into, then through, the housing 48B and through the exhaust intake 32 of the cook top 22. Simultaneously, the baffle plate 68 is effective for directing the flow of air from the second cooking unit, for example, from either the burners 24 or the open grill unit 28, through the louvered side wall 66 into, then through, the housing 48B and through the exhaust intake 32 of the cook top 22. In this manner, the airflow director 46B is effective for directing exhaust flow even when both sides of the cook top are in operation simultaneously. In all other respects, the airflow director 46B is of the same general construction as the airflow director 46.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A portable airflow director for ventilating a cook top adjacent to at least one cooking unit comprising:

an elongated housing including a base for removable engageable reception with an exhaust intake in the cook top, said base defining an opening in communication with the exhaust intake when said housing is placed on the cook top and a louvered side wall for directing the flow of air from the cooking unit into, then through, said housing and through the exhaust intake of the cook top, said housing further including a pair of end walls lying in parallel spaced apart planes and a solid side wall opposite said louvered side wall, said end walls and said solid side wall being impervious to the flow of air, said louvered side wall lying in a plane disposed at an angle of approximately 45° relative to a plane of said base.

2. A portable airflow director as set forth in claim 1 wherein said housing is composed of stainless steel.

3. A portable airflow director as set forth in claim 1 wherein said solid side wall and said louvered side wall lie in intersecting planes angularly disposed in relation to said base; and wherein said housing includes an integral upper beam member lying at the intersection of, and joining, said solid side wall and said louvered side wall.

4. A portable airflow director as set forth in claim 3 including:

a handle mounted on said upper beam member for selectively moving said housing onto and away from the cook top.

5. A portable airflow director for ventilating a cook top adjacent to and intermediate at least first and second cooking units, said portable airflow director comprising:

an elongated housing including:

a base for removable engageable reception with an exhaust intake in the cook top intermediate the first and second cooking units, said base defining an opening in communication with the exhaust intake when said housing is placed on the cook top;

first and second opposed louvered side walls extending between said end walls; and a baffle plate extending between said end walls intermediate said first and second louvered side walls for directing the flow of air from the first cooking unit through said first louvered side wall into, then through, said housing and through the exhaust intake of the cook top and, simultaneously for directing the flow of air from the second cooking unit through said second louvered side wall into, then through, said housing and through the exhaust intake of the cook top.

6. A portable airflow director as set forth in claim 5 wherein said housing includes:

a pair of end walls lying in parallel spaced apart planes and being impervious to the flow of air.

7. A portable airflow director as set forth in claim 6 wherein each of said first and second louvered side walls lies in a plane disposed at an angle of approximately 45° relative to a plane of said base.

8. A portable airflow director as set forth in claim 5 wherein said housing is composed of stainless steel.

9. In combination with a cook top including at least one cooking unit and exhaust means having an exhaust intake for producing a flow of air from said cooking unit to an external region, a portable airflow director for directing the flow of air from said cooking unit to the external region comprising:

an elongated housing including a base for removable engageable reception with the exhaust intake in said cook top, said base defining an opening in communication with the exhaust intake when said housing is placed on said cook top and a louvered side wall for directing the flow of air from said cooking unit into, then through, said housing and through the exhaust intake of said cook top, said housing further including a pair of end walls lying in parallel spaced apart planes and a solid side wall opposite said louvered side wall, said end walls and said solid side wall being impervious to the flow of air, said louvered side wall lying in a plane disposed at an angle of approximately 45° relative to a plane of said base.

10. The combination as set forth in claim 9 wherein said housing is composed of stainless steel.

11. The combination as set forth in claim 9 wherein said solid side wall and said louvered side wall lie in intersecting planes angularly disposed in relation to said base; and wherein said housing includes an integral upper beam member lying at the intersection of, and joining, said solid side wall and said louvered side wall.

12. The combination as set forth in claim 11 including:

a handle mounted on said upper beam member for selectively moving said housing onto and away from said cook top.

* * * * *